US005226307A

United States Patent [19]

Heitze

[11] Patent Number: 5,226,307

[45] Date of Patent: Jul. 13, 1993

[54] SLAB UPSETTING PRESS FOR HOT-ROLLED WIDE STRIP ROLLING MILLS

[75] Inventor: Gerhard Heitze, Netphen, Fed. Rep. of Germany

[73] Assignee: SMS Schloemann-Siemag Aktiengesellschaft, Dusseldorf, Fed. Rep. of Germany

[21] Appl. No.: 787,057

[22] Filed: Nov. 4, 1991

[30] Foreign Application Priority Data

Nov. 3, 1990 [DE] Fed. Rep. of Germany ..... 4035002

[51] Int. Cl.[5] ..... B21J 13/04; B21J 7/18

[52] U.S. Cl. ..... 72/455; 72/184; 72/407

[58] Field of Search ..... 72/184, 206, 455, 416, 72/407

[56] References Cited

U.S. PATENT DOCUMENTS 3,261,197 7/1966 Weyer ..... 72/407
3,878,708 4/1975 Kralowetz et al. ..... 72/407
5,077,999 1/1992 Rohde ..... 72/184

FOREIGN PATENT DOCUMENTS 3917398 12/1990 Fed. Rep. of Germany .

*Primary Examiner*—David Jones
*Attorney, Agent, or Firm*—Anderson Kill Olick & Oshinsky

[57] ABSTRACT

An upsetting press for the reduction of rolled material, particularly for reducing the slab width in hot-rolled wide strip breaking-down trains. The upsetting press includes tool carriers arranged on both sides of the slab and pressing tools which are movable in direction of slab reduction by means of a crank drive arranged in a crank housing. Each lower longitudinal post member of the upsetting press facing the press foundation has approximately in the middle thereof a fixed foundation bearing and longitudinally spaced from the fixed bearing at least two movable bearings. The crank housing can be locked between the upper and lower post members with releasable clamping devices.

13 Claims, 5 Drawing Sheets

SLAB UPSETTING PRESS FOR HOT-ROLLED WIDE STRIP ROLLING MILLS

BACKGROUND OF THE INVENTION

1. Field of the Invention

The present invention relates to an upsetting press for the reduction of rolled material, particularly for reducing the slab width in hot-rolled wide strip breaking-down trains. The upsetting press includes tool carriers which are arranged on both sides of the slab edges and include pressing tools which can be moved in the direction of slab reduction by means of a crank drive arranged in a crank housing.

2. Description of the Related Art

In an upsetting press disclosed in German patent application P 39 17 398.4, for reducing the width of slabs in a hot-rolled wide strip breaking-down train, pressing tools are arranged on both sides of the slab edges, wherein the pressing tools are mounted in tool carriers. For forming a reduction drive, each pressing tool is moved together with the corresponding tool carrier in the direction of the width reduction of the slab by means of a lever system actuated by a crank drive, wherein the crank drive is arranged in a crank housing. The crank drive is composed of two driven eccentric shafts, wherein a connecting member is mounted on each eccentric shaft, and wherein the head of the connecting member is connected to the tool carrier for transmitting the upsetting forces. A feed drive operating essentially in slab feeding direction acts on the tool carrier.

The features described above make it possible to separately control the sequence of movement of the pressing tools for the pressing action for reducing the slabs and for the feeding movement of the pressing tools, so that for any chosen feeding distance, a synchronization of the movement of the pressing tools with the movement of the slab to be pressed laterally is insured. This upsetting press makes possible the continuous reduction of the width of the slab to values predetermined by rolling technology. Upsetting presses of this size are capable of reducing in only one pass a slab having a width of about 2100 mm and a thickness of about 265 mm by up to 300 mm. Because of the high upsetting pressing forces of up to 30 MN and under the influence of heat, the horizontal upsetting stand must be able to expand without exerting forces on the foundation. In addition, the crank housing from which the pressing forces are introduced into the slab may not move during the pressing procedure in its guiding play, so that a desired width tolerance of the reduced slab can be ensured with high edge quality even in continuous operation.

SUMMARY OF THE INVENTION

Therefore, it is the object of the present invention to provide an upsetting press of the above-described type which is constructed in such a way that the influence of the pressing forces, particularly also of the mass forces and the influence of heat on the upsetting press and on the crank housing, do not lead to damage to the press and to a reduction of the quality of the upset slab or the edge quality thereof, and that a predetermined width tolerance of the upset slab can be ensured.

In accordance with the present invention, in an upsetting press of the above-described type, each lower longitudinal post member of the upsetting press facing the press foundation has approximately in the middle thereof a fixed foundation bearing and longitudinally spaced from the fixed bearing at least two movable bearings. In addition, the crank housing can be locked between the upper and lower longitudinal post members by means of releasable clamping devices.

Thus, the pressing forces produced during pressing an the mass forces resulting from the masses being moved are initially absorbed by the crank housing which is fixedly or tightly clamped in the housing post, and the forces are then conducted to and absorbed by the longitudinal post members. Starting from the fixed bearing in the middle, the longitudinal expansions of the post members caused by the pressing forces can be absorbed by several movable bearings. In this manner, it is possible to absorb also thermal expansions during the hot operation of the upsetting press, so that the lateral upsetting of the press leads to uniformly good upsetting results.

The fixed bearing of the upsetting press is formed by providing each lower longitudinal post member approximately in the middle thereof with lateral claws. Each lower longitudinal post member is supported on a fitting plate in a bearing plate connected to the foundation with side plates guiding the post member. The lateral claws engage in the side plates and the claws can be clamped together with the bearing plate by means of connecting elements, preferably in the form of screw connections. The structural elements described above result in a very robust construction of the fixed bearing of the upsetting press, and a very secure and stationary anchoring of this heavy machine on the foundation in the middle of the pitch line of the remaining hot-rolling mill stands is ensured.

The movable bearing of the upsetting press is formed in accordance with the present invention in that the lower longitudinal post member which in this area faces the foundation has a metal pressure plate, that a bearing plate which is connected to the foundation and is located opposite the metal pressure plate is provided with another metal pressure plate, and that arranged between the metal pressure plates are a stainless polished metal plate and a sliding plate of plastics material, preferably polytetrafluoroethylene (PTFE). The polished metal plate is mounted in one of the metal pressure plates and the sliding plate of plastics material is mounted in the other of the metal pressure plates. The sliding plate has on the sliding surface thereof recesses which can be filled with lubricant. The above-described construction of the loose bearings meets very high requirements. In particular, the sliding plate of PTFE very significantly reduces the resistance of sliding friction. Of particular advantage are the recesses with a lubricant arranged on the upper sliding surface of the sliding plate of PTFE. As a result, the influence of so-called microfriction between the sliding surfaces of such a bearing can be substantially reduced.

In accordance with the another feature of the invention, the metal pressure plates of the movable bearing are of stainless steel. In addition, the metal pressure plates are glued and screwed to the post member and the bearing plate, respectively. Thus, the supports of the housing posts of the upsetting press are essentially protected against corrosion. It is an additional advantage if the screw heads mounted in the pressure plates are surrounded with a sealing filling substance before the polished metal plate or the sliding plate of PTFE are mounted in the pressure plate.

In accordance with another feature for obtaining a movable bearing with lateral guidance, the movable bearing has side plates which are connected with the bearing plate and guide the longitudinal post member. Vertical sleeves are arranged in bores of lateral claws of the longitudinal post member. The vertical sleeves rest on the bearing plate and the other ends of the vertical sleeves have at a slight distance above the claws a counter plate. A screw connection extending into the bearing plate or the foundation is supported on the counter plate. Fitting plates which slide relative to each other are arranged between the claws and the side plates. The measures described above ensure that the housing post is expandable in longitudinal direction while still maintaining a secure lateral guidance. Because of the arrangement of the vertical sleeves, all clamping forces are conducted from the screw connection directly into the bearing plates.

The present invention further proposes, for supporting the housing posts several times on the foundation, the arrangement of a plurality of movable bearings with or without lateral guidance of the longitudinal post member arranged on both sides of the fixed bearing.

In order to ensure a problem-free mounting of the crank housing within the upsetting press, another further development of the present invention provides that the clamping devices for the crank housing are hydraulic clamping cylinders which can be adjusted in dependence on the pressing forces in such a way that the crank housing cannot move back and forth in its guide play during the pressing procedure. It is advantageous in this connection if the hydraulic clamping cylinders are located on each upper longitudinal side of the crank housing, opposite the lower side of the upper longitudinal post member and are further arranged between the outer side of each lower longitudinal post member and a guide rail which is fastened to the crank housing and engages at a distance over the lower longitudinal post member. The crank housing is clamped laterally by two hydraulic clamping cylinders and is pressed by four hydraulic cylinders onto the two lower longitudinal post members.

In accordance with another advantageous feature, in the releasable clamping device for the crank housing, a sliding plate is arranged between the clamping cylinder and each clamping surface and it is further provided that the crank housing rests on the lower longitudinal post members by means of sliding plates, so that the consequences of wear of the continuous microfriction between clamping cylinder and clamping surface are reduced to a minimum.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
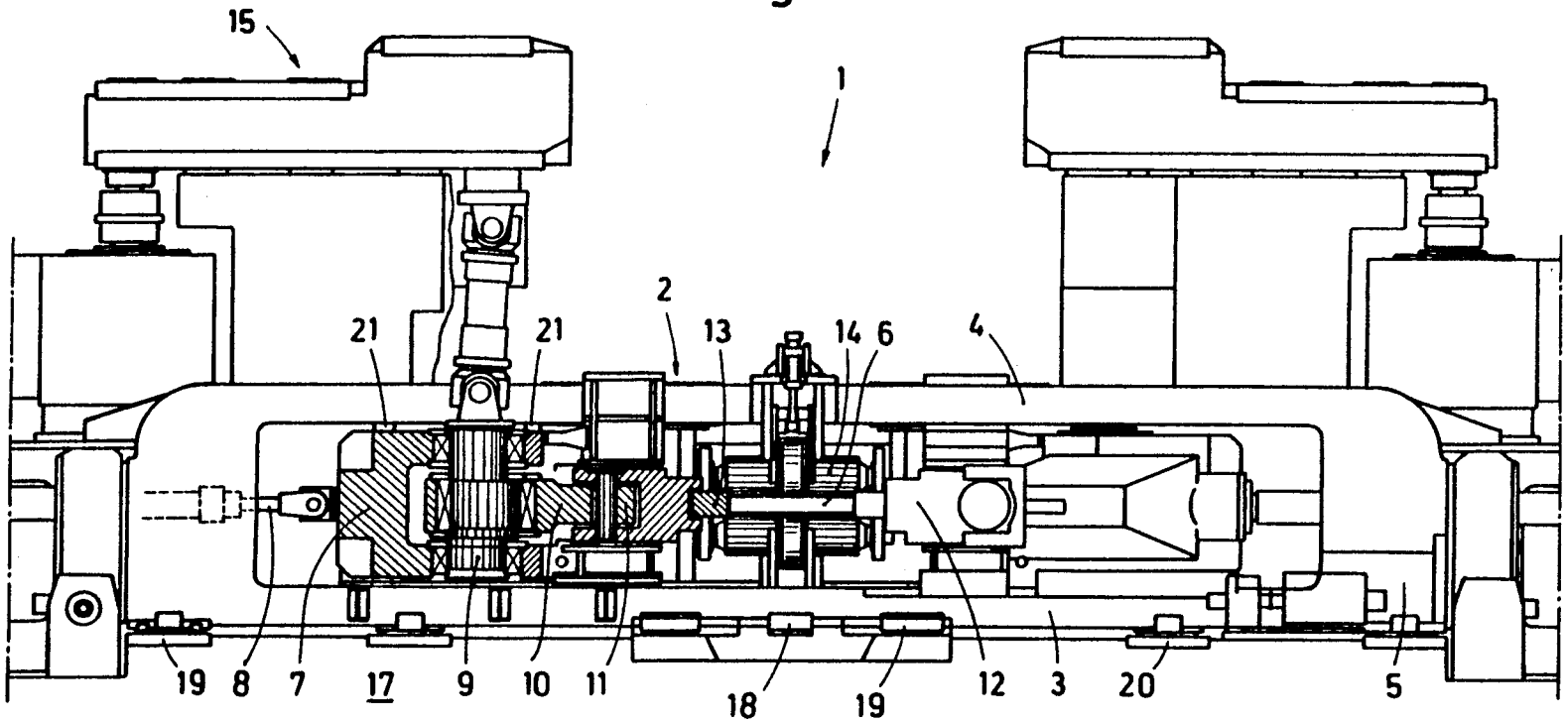
FIG. 1 is a schematic side view, partially in section, of an upsetting press with a horizontal housing post which rests at several locations on a foundation.

FIG. 1 of the drawing is a side view, partially in section, of the upsetting press 1 according to the present invention. The upsetting press 1 includes a horizontal housing post 2 with two lower longitudinal post members 3 and two upper longitudinal post members 4 and transverse members 5 which connect the longitudinal post members. A crank housing 7 is arranged between the longitudinal post members 3 and 4 and on both sides of a slab 6 whose width is to be reduced.

The crank housing 7 rests on a mechanical adjustment means, not illustrated in detail, and a balancing device 8 on the transverse members 5 of the housing post. Two eccentric shafts 9 with pressure connecting members 10 are mounted in the crank housing 7. The connecting member heads 11 are connected to a tool carrier 12 for the pressing tools 13. The slab 6 which is conveyed by means of driving rolls 14 through the upsetting press is reduced in its width by means of the pressing tools 13 and by means of the pressing forces produced by the crank drive. The pressing forces are transmitted from a motor and gearing arrangement 15 to the eccentric shaft by means of universal joint shafts 16.

The lower longitudinal post members 3 rest on the foundation 17 at several locations. In the middle portion of the upsetting press, the support is by means of a fixed bearing 18 and on both sides of the fixed bearing 18 are arranged a movable bearing 19 with lateral guidance, a movable bearing 20 without lateral guidance and a movable bearing 19 with lateral guidance. Releasable clamping devices 21 are arranged between the lower longitudinal post members 3 and the upper longitudinal post members 4 for supporting and locking the crank housing 7 in the housing post 2.

As a result of the proposed manner of support of the upsetting press on the foundation and the selected locking of the crank housing in the upsetting press, it is possible that the posts can expand freely under the influence of pressing forces and heat in the direction of the pressing forces without exerting forces on the foundation. In the following, the structural features of fixed bearings, movable bearings and locking means are described in more detail.

Figure 2:
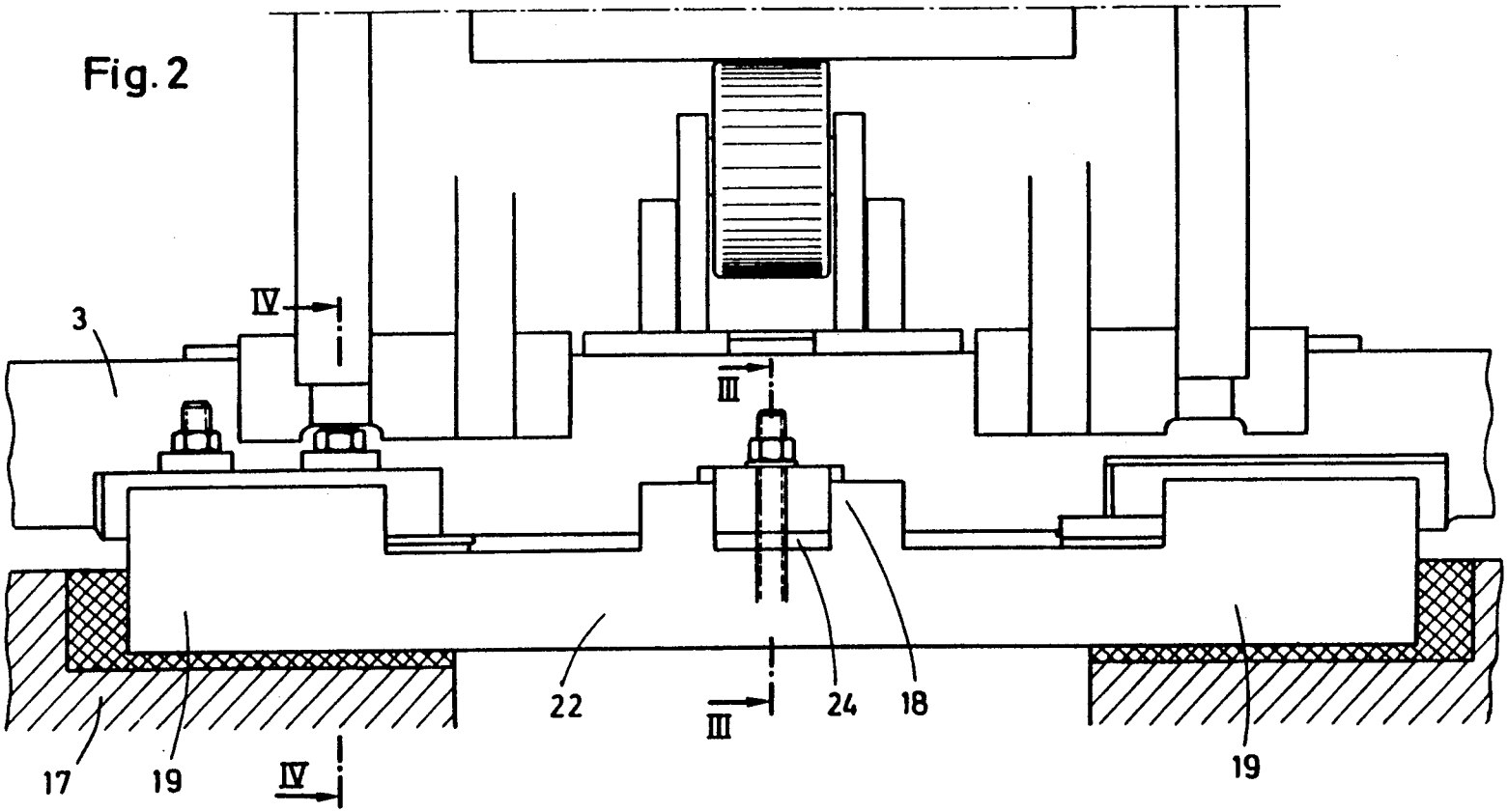
FIG. 2 is a schematic view of the middle bearing plate of the housing post with fixed bearing and movable bearing.
Figure 3:
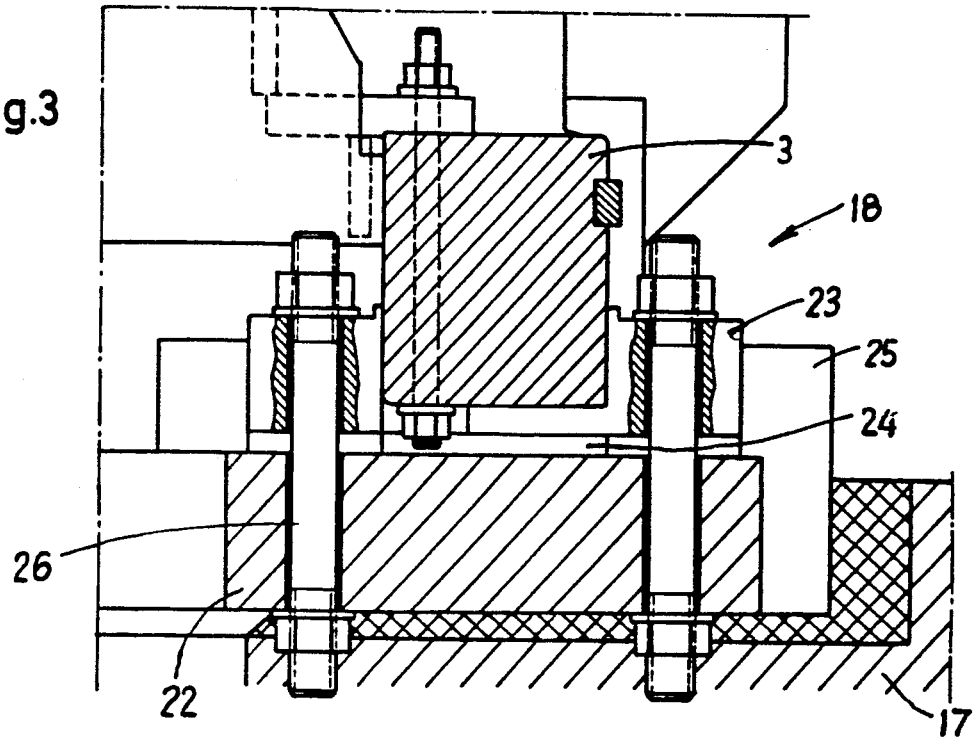
FIG. 3 is a sectional view of the fixed bearing taken along sectional line II–III of FIG. 2.

FIG. 2 of the drawing shows a bearing plate 22 connected to the foundation 17 for the fixed bearing 18 in the middle and two movable bearings 19 with lateral guidance on both sides for the two lower longitudinal post members 3. The longitudinal section taken along sectional line III—III in FIG. 2 shows in FIG. 3 that, for forming the fixed bearing 18, each lower longitudinal post member has approximately in the middle of the post member lateral claws 23 and that each lower longitudinal post member rests on a fitting plate 24 which, in turn, rests on the bearing plate 22 which is connected to the foundation 17, and that two lateral side plates 25 are arranged for guiding the post member. The lateral claws 23 of the longitudinal post members engage in the side plates 25 and the claws 23 are tightly clamped to the bearing plate 22 by means of the screw connections 26.

Figure 4:
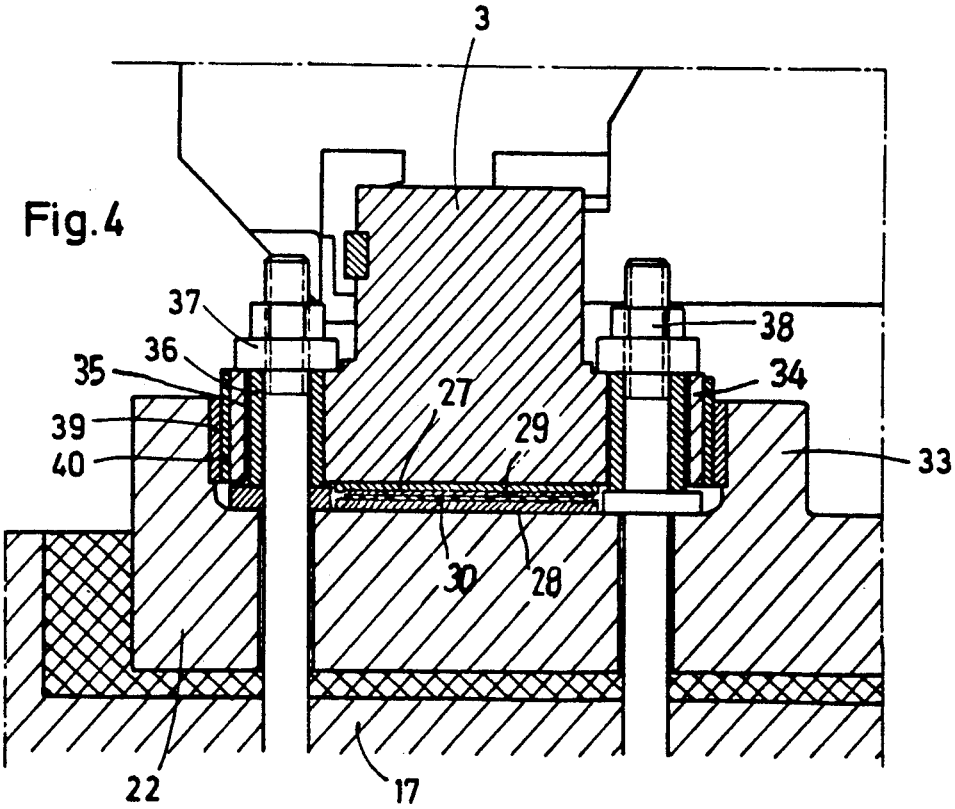
FIG. 4 is sectional view of the movable bearing with lateral guidance taken along sectional line IV—IV in FIG. 2.
Figure 5:
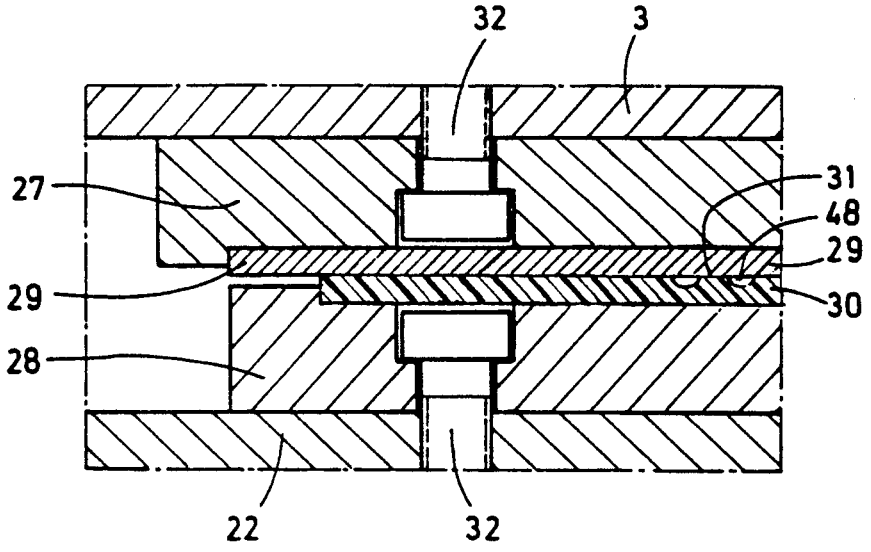
FIG. 5 is a sectional view of the movable bearing without lateral guidance.

FIG. 4 of the drawing shows the movable bearings in a longitudinal sectional view taken along sectional line IV—IV in FIG. 2. Thus, in the region of the movable bearing, the side of the lower longitudinal post member facing the foundation 17 has a metal pressure plate 27 and the bearing plate 22 which is located opposite the pressure plate 27 and is connected to the foundation 17 is also provided with a metal pressure plate 28 (compare with FIG. 5). A stainless polished metal plate 29 as well as a slide plate 30 are arranged between the metal pressure plates 27 and 28. The sliding plate 30 is of plastics material, preferably polytetrafluoroethylene (PTFE). The polished metal plate and the sliding plate of PTFE are inserted in the metal pressure plates 27 and 28, respectively. As shown in FIG. 5, the sliding surface 31 of the sliding plate 30 of plastics material facing the polished metal plate 29 has recesses 48 which are filled with lubricant for reducing the microfriction.

The metal pressure plates 27 and 28 are of stainless steel, are glued to the lower longitudinal post member 3 or the bearing plate 22 and, are screwed by means of screws 32 to the housing post or the bearing plate. The screw head mounted flush in the pressure plate 27, 28 is additionally surrounded by a filling substance, so that any corrosion at the connecting points of the bearing elements is eliminated as much as possible. It is apparent that FIG. 5 of the drawing shows the bearing elements of a movable bearing without lateral guidance for the longitudinal post members.

Referring again to FIG. 4, the movable bearing with lateral guidance shown in this figure has two side plates 33 which are connected to the bearing plate 22 and guide the longitudinal post member 3. Lateral claws of the lower longitudinal post member 3 have bores 35 for vertical bushings 36. These vertical bushings 36 rest on the bearing plate 22 and have at the other end thereof at a slight distance above the lateral claws 34 a counter plate 37. Resting on the counter plate 37 is a screw connection 38 which extends into the bearing plate 22 or the foundation 17. Arranged between the lateral claws 34 of the longitudinal post member and the side plates 33 are fitting plates 39 and 40 which slide relative to each other and which, on the one hand, are connected to the claw 34 and, on the other hand, are connected to the inner side of the side plate by gluing and/or by means of screws.

Figure 6:
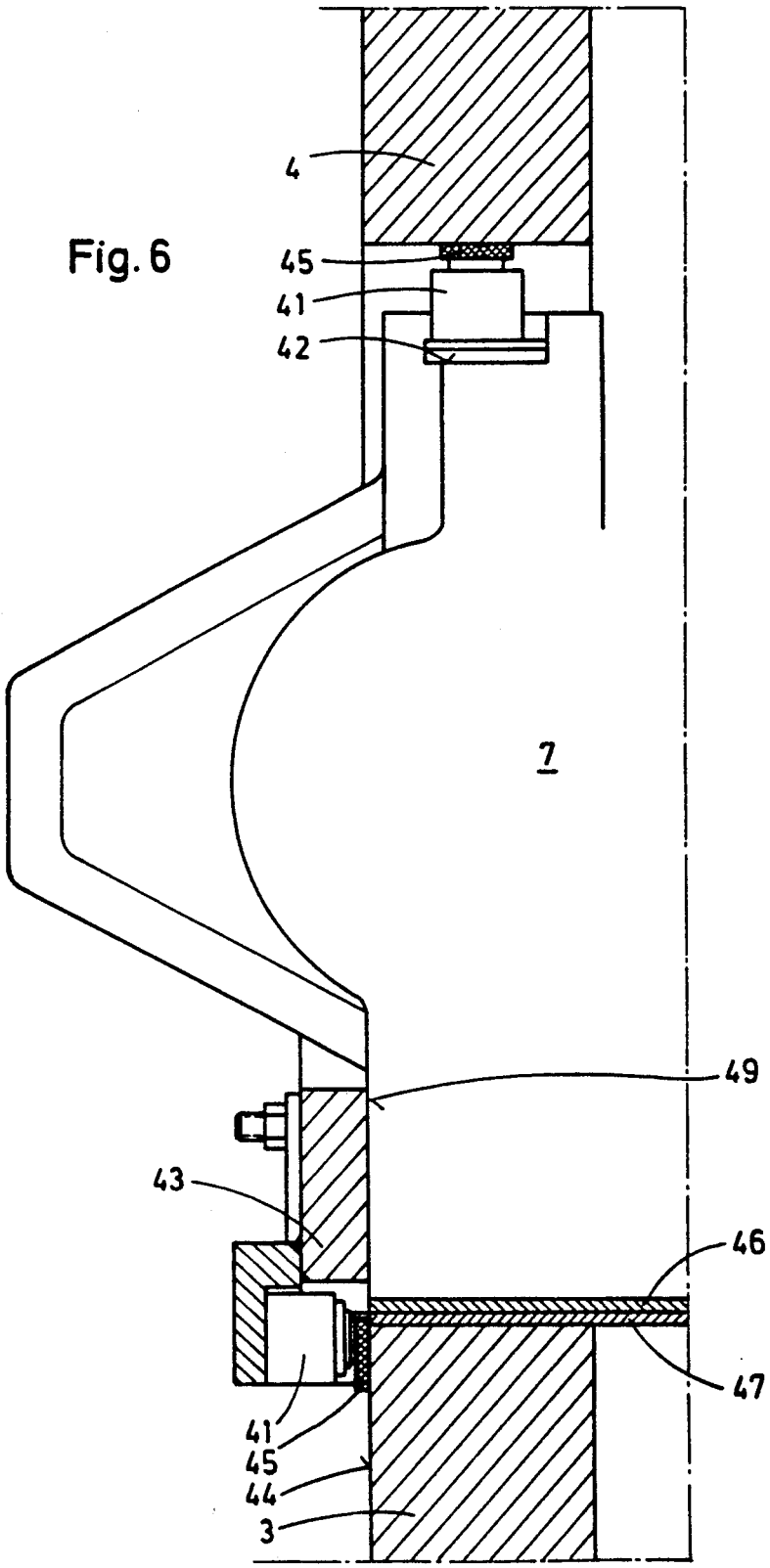
FIG. 6 is a partial sectional view of the crank housing clamped between the longitudinal members.

FIG. 6 of the drawing is a partial sectional view showing the crank housing 7 and the lower longitudinal post member 3 and the upper longitudinal post member 4. The crank housing 7 is locked between the upper and lower longitudinal post members by means of releasable clamping device 21. The clamping devices are hydraulic clamping cylinders 41. The clamping cylinders 41 are located on each upper longitudinal side 42 of the crank housing 7 and opposite the bottom side of the upper longitudinal post member 4. A guide rail 43 is mounted on the lower part of the crank housing 7 at the outer side 49 thereof. The guide rail 43 extends at a distance over the lower longitudinal post member 3. The hydraulic clamping cylinder 41 is arranged between the guide rail 43 and the outer side 44 of the lower longitudinal post member. A sliding plate 45 is arranged between each of the clamping cylinders 41 and the oppositely located clamping surface. The crank housing 7 rests on the lower longitudinal post member 3 by means of a pair of sliding plates 46, 47. Any wear due to continuous microfriction is substantially prevented by means of the sliding plates 45, 46 and 47.

The features described above ensure in a surprisingly simple manner that all expansions due to thermal influences and pressing forces can be absorbed by the housing posts of the upsetting press without conducting unduly high forces into the foundation.

While a specific embodiment of the invention have been shown and described in detail to illustrate the inventive principles, it will be understood that the invention may be embodied otherwise without departing from such principles.

I claim:

1. An upsetting press for the reduction of rolled material, particularly for reducing a width of a slab in hot-rolled wide strip breaking-down trains, the upsetting press being mounted on a press foundation, the upsetting press including tool carriers arranged on both sides of the slab and pressing tools which are movable in direction of slab reduction by means of a crank drive arranged in a crank housing, the upsetting press having a plurality of upper longitudinal post members and a plurality of lower longitudinal post members supported on the press foundation, each lower longitudinal post member of the upsetting press having approximately in a middle portion thereof a fixed foundation bearing and longitudinally spaced from the fixed bearing at least two movable bearings, the crank housing being lockable between respective upper and lower longitudinal post members by means of releasable clamping devices, wherein for forming the fixed bearing, each lower longitudinal post member has lateral claws approximately in the middle portion thereof and is supported on a fitting plate in a bearing plate connected to the foundation wand with side plates guiding each lower longitudinal post member, wherein the lateral claws engage in the side plates, and wherein connecting elements for clamping the claws to the bearing plate are provided.

2. The upsetting press according to claim 1, wherein the connecting elements are screw connections.

3. The upsetting press according to claim 1, wherein, for forming each of the movable bearings of the upsetting press, the lower longitudinal post member includes a first metal pressure plate, a bearing plate is connected to the foundation, is located opposite the first metal pressure plate, and includes a second metal pressure plate, a stainless steel polished metal plate and a sliding plate of plastics material being arranged between the metal pressure plates, wherein the polished metal plate is mounted in one of the metal pressure plates and the sliding plate of plastics material is mounted in the other of the metal pressure plates, and wherein the sliding plate has on a sliding surface thereof recesses which can be filled with lubricant.

4. The upsetting press according to claim 3, wherein the sliding plate is of polytetrafluoroethylene.

5. The upsetting press according to claim 3, wherein the metal pressure plates of the movable bearing are of stainless steel, and wherein the metal pressure plates are glued and screwed to the post member and the bearing plates, respectively.

6. The upsetting press according to claim 3, wherein the movable bearing includes side plates which are connected to the bearing plate and guide each lower longitudinal post member, vertical sleeves being arranged in bores of additional lateral claws of each lower longitudinal post member, the vertical sleeves having first ends resting on the bearing plate and second ends, opposite to the first ends, having at a slight distance above the claws a counterplate, a screw connection extending into the bearing plate or the foundation being supported on the counterplate, and fitting plates which slide relative to each other being arranged between the claws and the side plates.

7. The upsetting press according to claim 1, comprising an alternating sequence of movable bearings with lateral guidance and movable bearings without lateral guidance arranged adjacent to both sides of the fixed bearing.

8. The upsetting press according to claim 1, wherein the crank housing rests on the lower longitudinal post members by means of sliding plates.

9. An upsetting press for the reduction of rolled material, particularly for reducing a width of a slab in hot-rolled wide strip breaking-down trains, the upsetting press being mounted on a press foundation, the upsetting press including tool carriers arranged on both sides of the slab and pressing tools which are movable in direction of slab reduction by means of a crank drive arranged in a crank housing, the upsetting press having a plurality of upper longitudinal post members and a plurality of lower longitudinal post members supported on the press foundation, each lower longitudinal post member of the upsetting press having approximately in a middle portion thereof a fixed foundation bearing and longitudinally spaced from the fixed bearing at least two movable bearings, wherein the crank housing is lockable between respective upper and lower longitudinal post members by means of releasable clamping devices, and wherein the releasable clamping devices are hydraulic clamping cylinder.

10. The upsetting press according to claim 9, wherein the hydraulic clamping cylinder is located on an upper longitudinal side of the crank housing opposite a lower side of the upper longitudinal post member, and are further arranged between a outer side of the lower longitudinal post member and a guide rail which is fastened to the crank housing and engages at a distance over the lower longitudinal post member.

11. The upsetting press according to claim 10, comprising a sliding plate mounted between each clamping cylinder and a clamping surface of the longitudinal post member.

12. An upsetting press for the reduction of rolled material, particularly for reducing a width of a slab in hot-rolled wide strip breaking-down trains, the upsetting press being mounted on a press foundation, the upsetting press including tool carriers arranged on both sides of the slab and pressing tools which are movable in direction of slab reduction by means of a crank drive arranged in a crank housing, the upsetting press having a plurality of upper longitudinal post members and a plurality of lower longitudinal post members supported on the press foundation, each lower longitudinal post member of the upsetting press having approximately in a middle portion thereof a fixed foundation bearing and longitudinally spaced from the fixed bearing at least two movable bearings, the crank housing being lockable between respective upper and lower longitudinal post members by means of releasable clamping devices, wherein for forming each of the movable bearings of the upsetting press, each lower longitudinal post member includes a first metal pressure plate and is supported on a bearing plate connected to the foundation, located opposite the first metal pressure plate and including a second metal pressure plate, and wherein a stainless steel polished metal plate and a sliding plate of plastics material are arranged between the first and second metal pressure plates.

13. The upsetting press according to claim 12, wherein the polished metal plate is mounted in one of the first and second metal pressure plates and the sliding plate is mounted in the other of the first and second metal pressure plates, and wherein the sliding plate has on a sliding surface thereof recesses which can be filled with lubricant.

* * * * *